US005186464A

United States Patent [19]

Lamle

[11] Patent Number: 5,186,464

[45] Date of Patent: Feb. 16, 1993

[54] CARD DEALING CASE

[76] Inventor: Stewart Lamle, 3 Fordham Hill Oval, Suite 15F, Bronx, New York City, N.Y. 10468

[21] Appl. No.: 782,571

[22] Filed: Oct. 25, 1991

[51] Int. Cl.[5] ..... A63F 1/14; A63F 1/10

[52] U.S. Cl. ..... 273/149 R; 273/148 A

[58] Field of Search ..... 273/149 R, 148 A, 287, 273/282, 260

[56] References Cited

U.S. PATENT DOCUMENTS

| | | | |
|---|---|---|---|
| D. 164,862 | 10/1951 | Johnson | 273/148 A |
| 389,873 | 9/1988 | Clark | 273/149 R |
| 798,261 | 8/1905 | Brown | 273/148 A |
| 847,570 | 3/1907 | Granger | 273/148 A |
| 912,110 | 2/1909 | Gill | 273/148 A |
| 2,222,245 | 11/1940 | Steen | 273/148 A |
| 3,814,436 | 6/1974 | Boren | 273/148 A |

FOREIGN PATENT DOCUMENTS

| | | | |
|---|---|---|---|
| 25184 | of 1904 | United Kingdom | 273/149 R |

*Primary Examiner*—Benjamin H. Layno
*Attorney, Agent, or Firm*—Robert W. J. Usher

[57] ABSTRACT

A card dealing case comprises an open-topped deck receiving housing and a sleeve form cover completely receiving the housing in a closed condition. The housing has a ramp surface adjacent a rim of the open top across which uppermost cards can be dealt, leading edges first, one-by-one by forward and downward pressure of a dealers finger. Releasable catch members are formed on the cover and housing to lock the housing containing the cards completely within the cover. In another example, the dealing opening in the top of the housing is of restricted size so that the identity of the uppermost card is concealed until dealt and a resiliently compressible foam pad is interposed in the housing between the bottom of the deck and the base wall to bias the deck towards the top of the housing, thereby maintaining the uppermost card aligned with the ramp surface after some cards have been dealt, irrespective of the height of the remaining deck.

22 Claims, 4 Drawing Sheets

CARD DEALING CASE

FIELD OF THE INVENTION

The invention relates to a card dealing case suitable both for containing the cards in a pocketable fashion and from which the cards may be readily dealt in a conventional manner.

BACKGROUND OF THE INVENTION

Card dealing cases or shoes are widely used in casinos for both housing and presenting the cards for dealing. However, such shoes are relatively bulky, complex in construction and expensive. The shoes are usually designed to contain as many as six decks of playing cards and to locate the respective cards of the composite deck extending substantially vertically with their edges on a ramp surface downwardly inclined towards the card table and provided at a leading end with a lowermost slot through which the leading cards can be successively dealt. A rolling weight must normally inserted into the shoe at the rear of the ramp in engagement with the rearmost card to ensure that the cards remain in their vertical alignments with the leading card at the dealing slot.

This results in a bulky and expensive construction, too cumbersome for portability with convenience and too large for pocketability, while the requirement for a rolling weight involves the inherent instability of an additional unsecured mass further reducing possibilities of convenient portability. Furthermore, the cards themselves are not sufficiently securely retained in the shoe to permit transportation thereof.

SUMMARY OF THE INVENTION

An object of the invention is to provide a card dealing case which both securely and conveniently retains the cards during transportation ensuring portability thereof and from which the cards may be conveniently dealt.

A further object of the invention is to provide a card dealing case which is pocketable, so that it may readily be carried on the person of the dealer.

An additional object of the invention is to provide a card dealing case in which resilient means are provided to bias the cards to a dealing position, such resilient means being fixed in the case at all times.

It is another object of the invention to provide a card dealing case in which the identity of the card to be dealt is concealed until the dealing thereof.

According to one aspect of the invention, there is provided a card dealing case comprising a housing having a horizontal base and an open top with a rim, means defining a ramp surface extending from the housing interior to the rim, and means locating a deck of cards stacked, face down, parallel to the base, therein with a leading edge of an uppermost card in alignment with the ramp surface; cover means releasably engagable with the housing to close the top retaining the deck in the housing; whereby uppermost cards can be dealt horizontally by sliding them sequentially, one-by-one, leading edges first from the top of the pack up the ramp surface and out from the housing by downward and forward pressure of the dealer's hand.

Preferably, the ramp means is formed by a forwardly inclined front wall which extends from the base to the rim enabling cards to continue to be dealt irrespective of the height of the stack remaining as cards are dealt.

In this case, the deck locating means includes a forwardly inclined rear wall upstanding from the base wall and confining the cards with leading edges thereof adjacent the front wall surface.

This affords a compact construction of neat appearance both avoiding excessive looseness and enabling the cards to be readily dealt in a reliable fashion.

In one embodiment, the locating means comprises means biassing the deck towards the top of the container avoiding a need for the dealer's finger to be inserted further into the housing as the stack is depleted.

Preferably, the biassing means comprises a resiliently compressible member, such as solid foam, interposed between the deck and the base wall.

Suitably, the ramp means is formed by a forwardly inclined front wall of the housing.

In one construction, the cover is of sleeve-form construction and receives the housing in the closed position.

Desirably, one of detent and indent means are provided on one of the cover and housing engagable therebetween to provide, in the closed position, the releasable engagement of the cover and housing.

In a particular embodiment, the sleeve is blind-ended and of rectangular cross-section perpendicular to an insertion axis receiving the housing in drawer fashion, rear wall first, and catch means are provided on the cover and housing including one of indent and detent means manually overidable by insertion of a finger through a finger receiving access aperture provided in the blind end of the cover by which the housing can be pushed out of the sleeve.

More specifically, said one of indent and detent means are provided on front edges of the rim and on the sleeve, respectively.

In one form of the invention, the sleeve is blind ended and of parallelogram cross section perpendicular to an insertion axis, receiving the housing, end wall first and catch means are provided on the cover and housing, including one of indent and detent means manually overidable by insertion of a finger through a finger receiving access aperture provided in the blind end of the cover by which the housing can be pushed out of the sleeve.

In another embodiment, the housing is rectangular in plan having a horizontally extending top wall extending across the top thereof to a location adjacent and spaced from the rim at the top of the front wall and rebated at a medial location so that the free edge thereof defines a narrow card exit aperture revealing therethrough only a leading strip portion of an uppermost card to be dealt without revealing identifying indicia on the card and defining a centrally located, enlarged aperture portion for receipt of a dealer's finger.

In a further example a top wall of a housing is constituted by a flap pivotally connected to one of the rear and side walls for pivotal movement between an open, card deck receiving position and a closed, card dealing position extending across the top. The housing may be removable from a cover, drawer fashion to a position in which a front, dealing end of the housing protrudes from the cover exposing the card dealing and finger receiving apertures, in which position, engagement between the cover and the flap maintains the flap on the housing top in the card dealing position against the action of a card biasing means.

BRIEF DESCRIPTION OF THE DRAWINGS

Specific embodiments of the invention will now be described by way of example only with reference to the accompanying drawings in which:

As shown in FIGS. 1-3, the card dealing case 11 comprises a sleeve-form cover 12 and a drawer-like, open topped housing 13 receivable completely therein.

Figure 1:
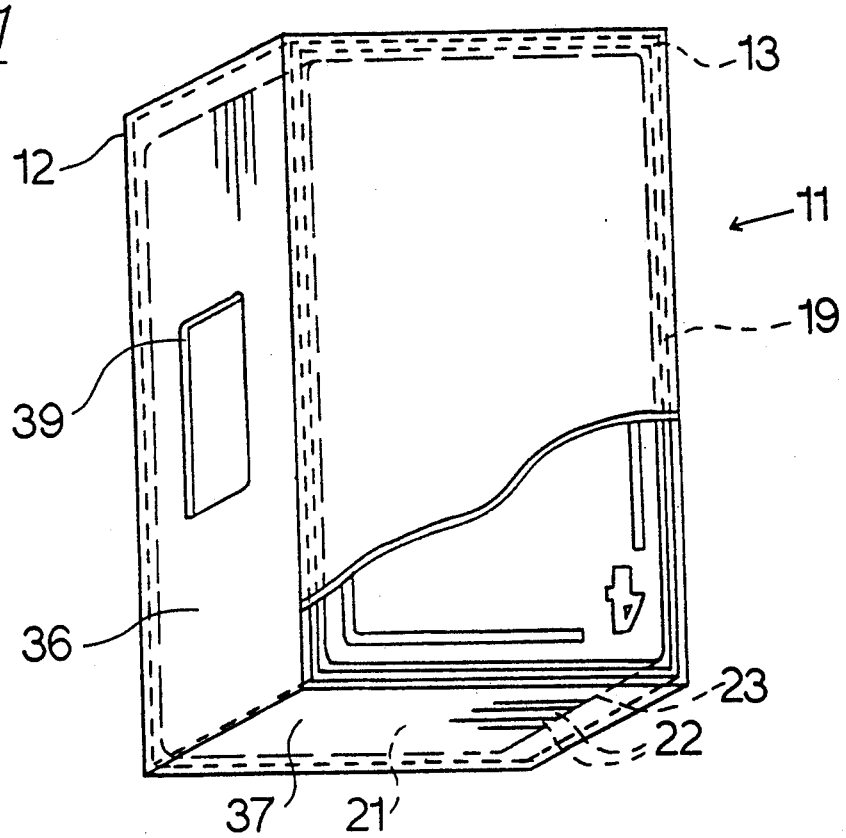
FIG. 1 is an isometric view of a first example of card dealing case according to the invention, in closed condition.

The housing 13 is molded in one piece of plastic material and comprises a rectangular base wall 14 from respective major and minor edges of which, front and rear walls 15 and 16, and opposite end walls 17 and 17', respectively, upstand, with top free edges thereof defining a rim 19 of a card dealing aperture at the open top.

Both end walls 17, 17' are of identical parallelogram shape while front and rear walls 15 and 16 are inclined forwardly at an angle of approximately 60° to the horizontal base wall 14, in a card dealing direction so that the front wall 15 provides a ramp surface extending to the rim and the rear wall confines a deck 21 of cards 22 with leading edges 23 thereof adjacent the front wall.

Figure 3:
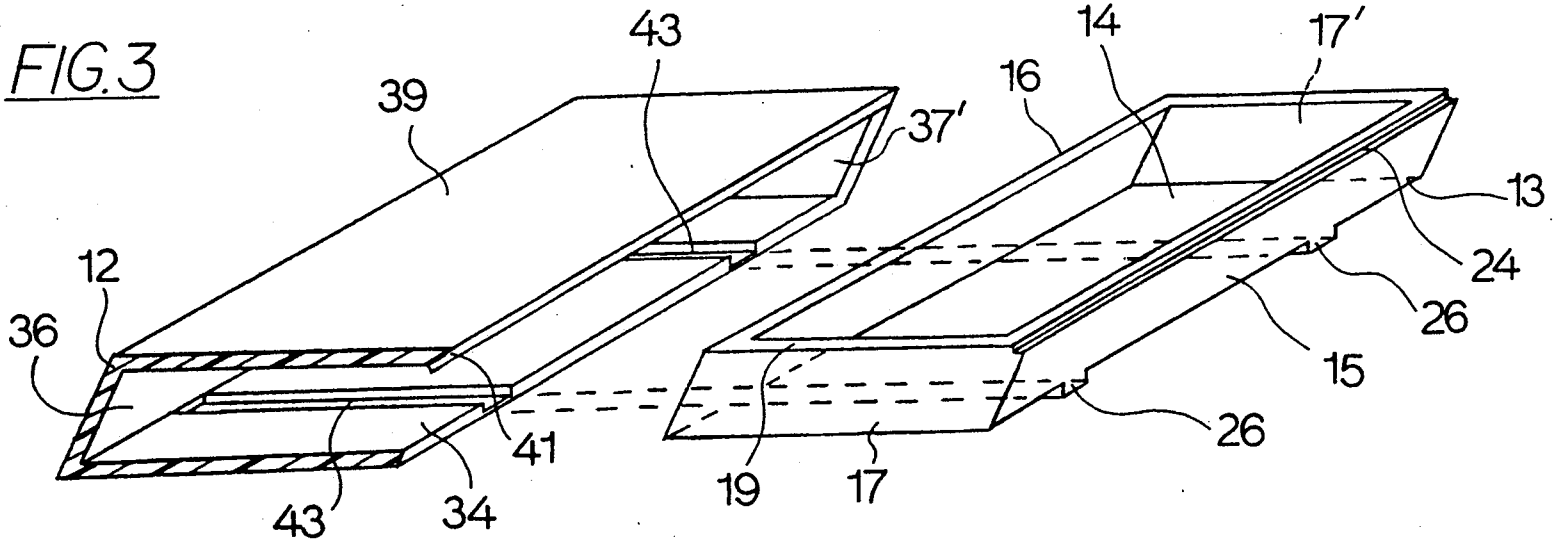
FIG. 3 is an exploded isometric view, partly in cross section, of the empty card dealing case.

An upper edge portion of the front wall 15 is formed with a longitudinally extending latching groove or step 24, enlarged in FIG. 3, for clarity. A pair of guiding ribs 26 extends from the front to the rear edge of the base wall in mutually spaced apart, parallel relation.

The cover 12 is of complementary shape to the housing, having a rectangular base wall 34 from a rear, major edge of which and minor end edges upstand a rear wall 36 and opposite end walls 37, 37', respectively being connected at top edges to a horizontal top wall 39.

The end walls 37, 37' are of identical parallelogram shape having free leading edges inclined to the horizontal at a similar angle to the front and rear walls 15 and 16 of the housing while the rear wall 36 is also similarly inclined so that the front edge of the top wall 39 overhangs the front edge of the base wall. A catch 41 is integrally formed with the front edge and depends therefrom and is engageable, releasably in the latching groove or step 24 with a detent action releasably to lock the housing in the cover.

The inside surface of the base wall is formed with a pair of housing guiding grooves 43 extending from the front edge of the base wall to the rear wall at the same spacing as the guiding ribs 26 of the housing, for receipt thereof when the housing is inserted in the cover.

The rear wall 36 is formed with a finger receiving access aperture 39 at a central location for receipt of a user's finger to release the housing 13 from the cover by pushing the rear wall 16.

Figure 2:
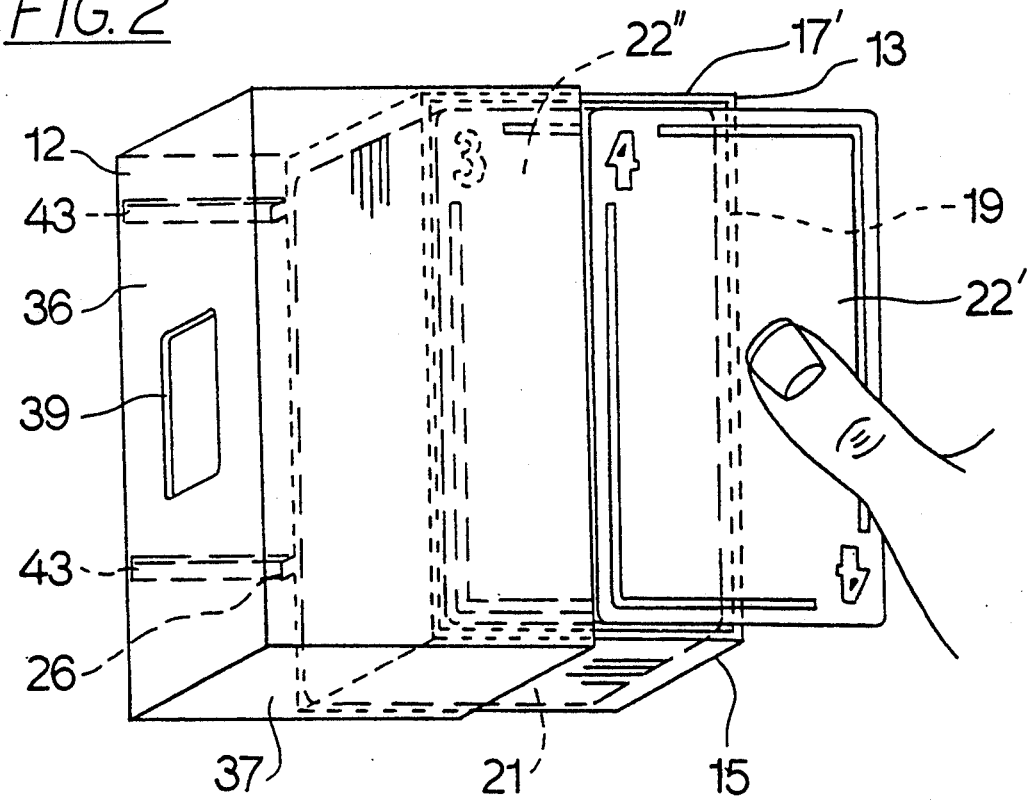
FIG. 2 is a similar view to FIG. 1, but with the card dealing case open and a card being dealt therefrom.

The dealing case is opened by inserting a finger through the aperture 39 and pressing the rear wall 16 of the housing causing the detent action of the catch 41 to be overridden forcing the catch from the groove 24 while pushing the housing, draw-fashion out of the open front of the cover. The housing may be whole or, as shown in FIG. 2, partly removed from the cover to enable uppermost cards 22' to be dealt horizontally sequentially, one-by-one from the deck by a single stroking, sweeping or wiping action of the dealers finger, the downward and forward pressure causing only the uppermost card 22' to slide across the card 22'' immediately below, urging the leading edge to ride up the ramp surface over the rim and out of the top of the housing.

In this way, all of the cards may be successively dealt one-by-one even though a considerable separation exists between the last card and the rim of the aperture only provided that the housing is removed sufficiently from the cover to expose a dealing opening sufficiently large to admit the dealers finger as far as the base of the housing.

Thus, it is possible to deal the cards either with the card dealing case base resting on a surface such as a card table or while holding the case in the dealing hand.

After shuffling a used deck can most easily be replaced in the housing by insertion through the completely opened top after complete removal of the housing from the cover.

Figure 4:
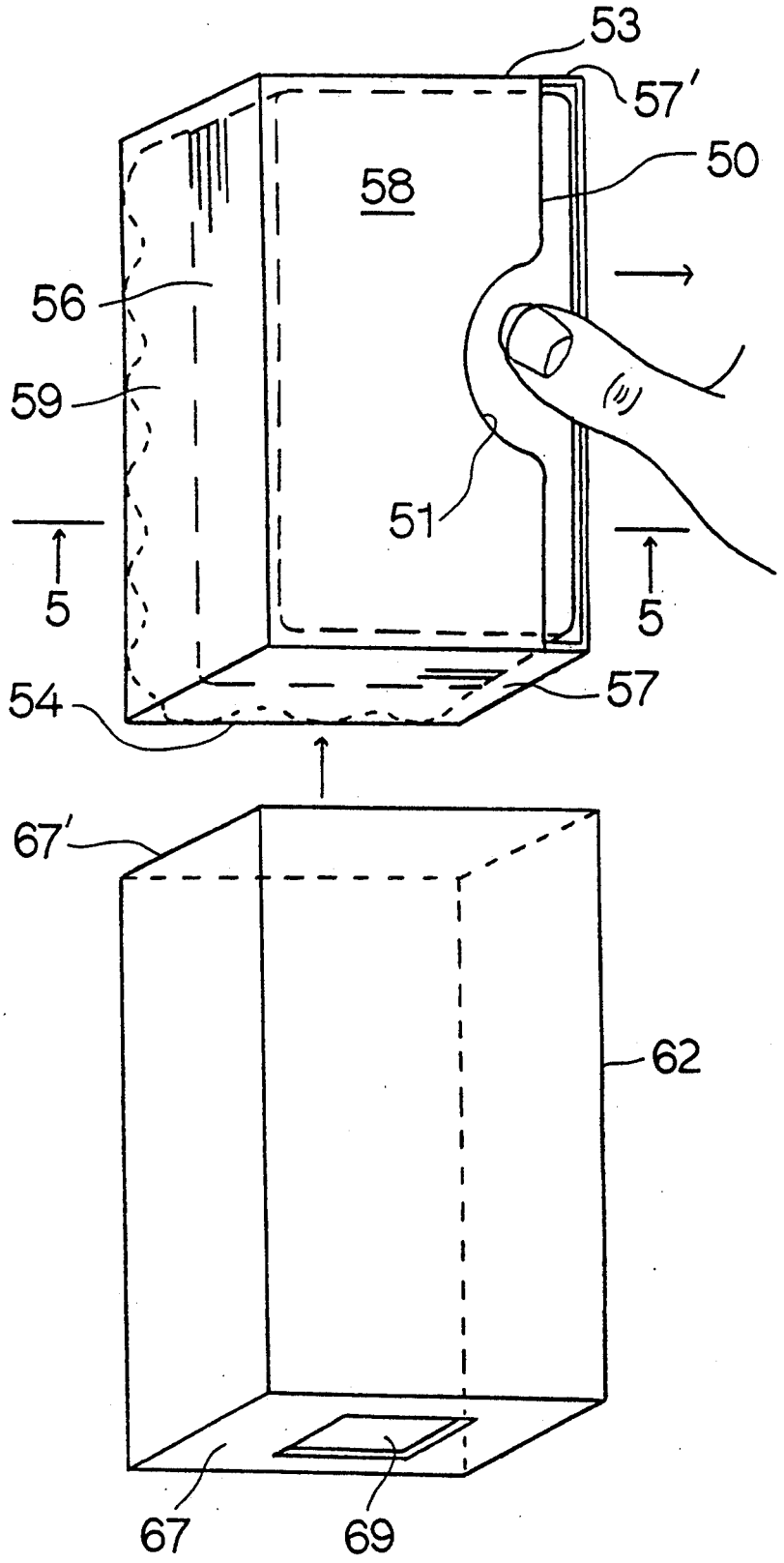
FIG. 4 is an isometric view of a second example of a card dealing case in the card dealing position.

This example is suitable for a deck of approximately fifty cards. However, the second example shown in FIGS. 4 and FIGS. 5(*a*) and (*b*) is intended for a larger deck of 100 double sided or double faced cards.

In the second example, a drawer-like housing 53 has a base wall 54, front and rear sidewalls 55 and 56, respectively, and opposite end walls 57 and 57', respectively, similarly shaped and located to those of the first example, except that the walls are of increased height to accommodate the increased size of the deck. In addition, a top wall 58 joins upper edges of the rear and end wall and extending forwardly, parallel to the base wall, to a position short of the upper edge of the front wall so as to define therewith a dealing opening 50 sufficiently wide to release an uppermost card but sufficiently narrow that the identity of the subsequent card is concealed until release. The identity of the uppermost card will, in a double faced or double sided pack or deck, normally be indicated by numbers placed adjacent corners thereof and in the center of the card.

The leading edge of the wall is rebated providing an arcuate opening 51 for admission of the dealer's finger.

A resiliently compressible solid plastic foam pad 59 is located on the base wall and topped by a stiff sheet 60 having a smooth, upper sliding surface, to bias the deck upwardly so that the uppermost card is always adjacent the dealing opening.

This example provides the advantages that both the identity of successively uppermost cards is concealed prior to dealing and a deck of greatly increased size can be accommodated.

The cover 62 is of complementary shape to the housing and similar in structure to the cover of the first example except that an access opening or aperture 69 is formed in an end wall 67 while the cover is open at the opposite end 67' to receive the housing therethrough instead of being open at the front.

It will be appreciated that, in this example, the housing must be completely removed from the cover for dealing, analogous releasable catch means (not shown)

being provided on an edge of a wall at the open end for engagement with the cover.

Figure 5B:
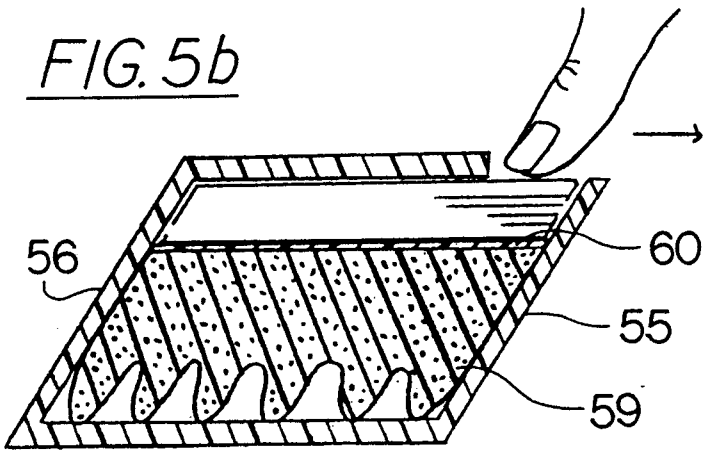
FIGS. 5*a* and *b* are similar cross sectional views along the line 5—5 of FIG. 4 with the card dealing case containing a full deck and after some cards have been dealt, respectively; and, FIG. 6 is a perspective view, partly broken away, of another example of the invention.
Figure 5A:
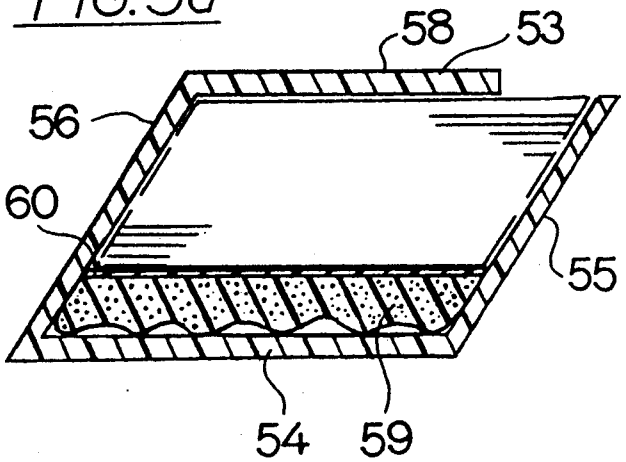

As shown by FIGS. 5a-5b the foam is in fully compressed condition when an entire deck is received in the housing and progressively expands to maintain the uppermost card aligned with the wrap surface defined by the front sidewall and within reach of the dealers finger while the cards are dealt from the housing.

In a further modification, one end of the housing may remain open to facilitate insertion of a fresh complete deck of cards therein and that end inserted first into the cover in the closed position.

Biassing means other than the plastic foam may be used such as a coil, cantilever or other spring member.

Figure 6:
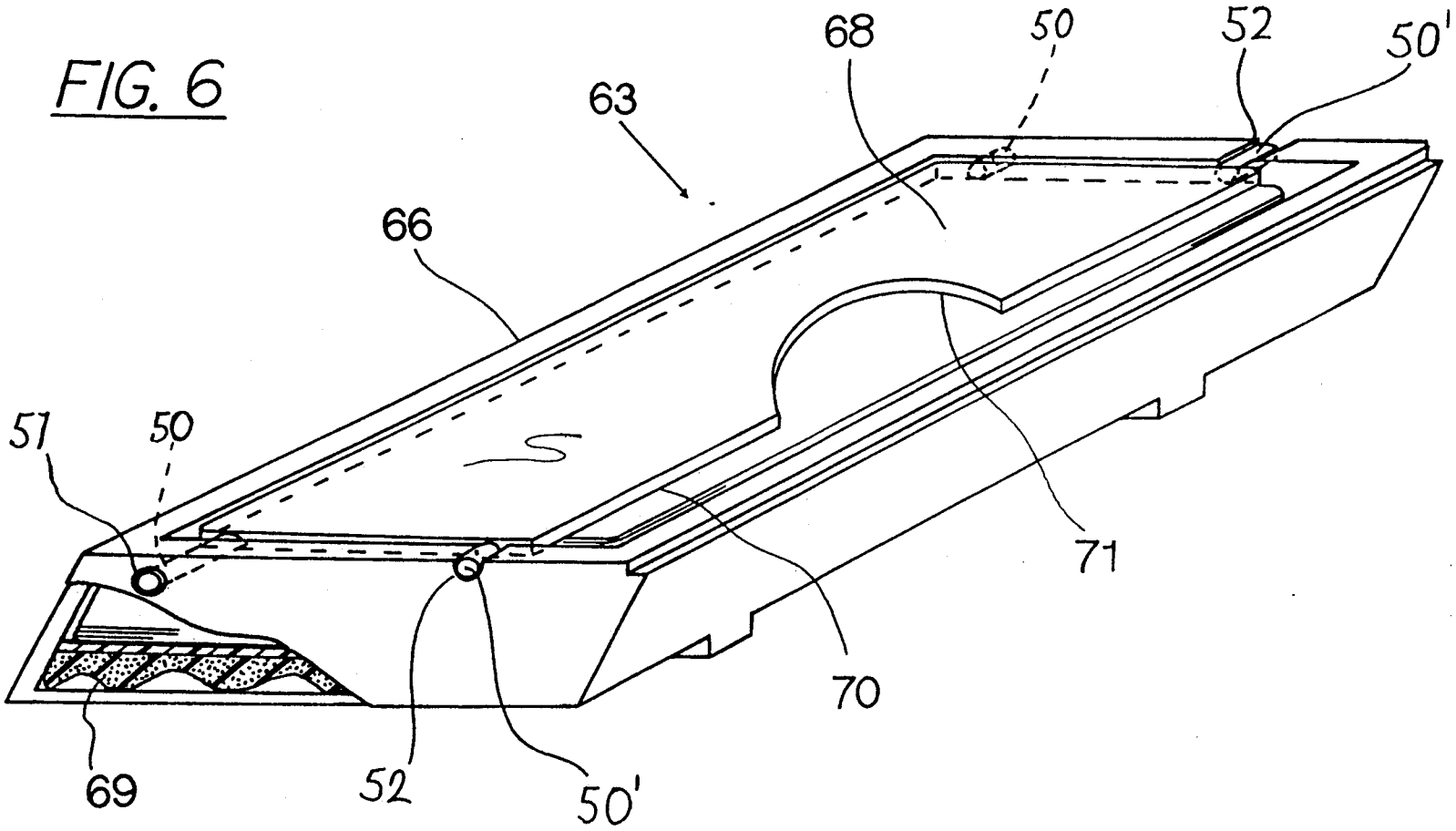

In the third example, shown in FIG. 6, an opaque flap 68, similar in shape to the top wall 58 of the housing 53 of the second example, is pivotally attached to a rear wall 66 of a housing 63 of similar construction to the housing 13 of the first example by trunnions 50 and 51' integrally formed therewith on opposite side edges adjacent rear and front ends, respectively, and received in apertures 51 and slots 52 in opposite housing sidewalls at locations adjacent the rear extending downwardly from upper edges adjacent the front, respectively.

In the closed position, the flap 68 will conceal the identities of successive uppermost cards while, in the raised or open position, the flap will enable the housing to be refilled by inserting the cards therein as a stack consisting of one or more decks.

The biasing means 69, or an equivalent thereof, is inserted in the housing to ensure that the uppermost card is adjacent the top and the flap 68 will be held down, during dealing, against the action of the biasing means, by a cover similar in construction to the cover 12 of the first example, as only the front end portion of the housing need be drawn from the cover to be sufficiently exposed for dealing.

The front end of the flap may be chamferred or radiussed (not shown) to allow free passage of a catch (similar to catch 41) on the cover thereover when drawing the front portion of the housing out from the cover.

I claim:

1. A card dealing case comprising a housing having a horizontal base and an open top with a rim, means defining a ramp surface extending from the housing interior to the rim, and means locating a deck of cards stacked, face down, parallel to the base, therein with a leading edge of an uppermost card in alignment with the ramp surface and comprising means biassing the deck towards the top of the housing;

cover means releasably engagable with the housing to close the top retaining the deck in the housing;

whereby uppermost cards can be dealt horizontally by sliding them sequentially, one-by-one, leading edges first from the top of the pack up the ramp surface and out from the housing by downward and forward pressure of the dealer's hand.

2. A card dealing case according to claim 1 wherein the ramp means is formed by a forwardly inclined front wall which extends from the base to the rim.

3. A card dealing case according to claim 2 in which the deck locating means includes a forwardly inclined rear wall upstanding from the base wall and confining the cards with leading edges thereof adjacent the front wall surface.

4. A card dealing case according to claim 1 in which the biassing means comprises a resiliently compressible member interposed between the deck and the base wall.

5. A card dealing case according to claim 4 in which the resiliently compressible member is solid foam.

6. A card dealing case according to claim 1 in which the ramp means is formed by a forwardly inclined front wall of the housing.

7. A card dealing case according to claim 1 in which the cover is of sleeve-form construction and receives the housing in the closed position.

8. A card dealing case according to claim 7 in which the sleeve is blind ended and of parallelogram cross section perpendicular to an insertion axis, receiving the housing, end wall first and catch means are provided on the cover and housing, including one of indent and detent means manually overidable by insertion of a finger through a finger receiving access aperture provided in the blind end of the cover by which the housing can be pushed out of the sleeve.

9. A card dealing case according to claim 1 in which one of detent and indent means are provided on one of the cover and housing engagable therebetween to provide, in the closed position, the releasable engagement of the cover and housing.

10. A card dealing case according to claim 1 in which the housing is rectangular in plan having a horizontally extending top wall extending across the top thereof to a location adjacent and spaced from the rim at the top of the front wall and rebated at a medial location so that the free edge thereof defines a narrow card exit aperture revealing therethrough only a leading strip portion of an uppermost card to be dealt without revealing identifying indicia on the card and defining a centrally located, rearwardly extending enlarged aperture portion for receipt of a dealer's finger.

11. A card dealing case according to claim 10 in which the top wall is constituted by a flap pivotally connected to one of the rear and side walls and moveable between an open, card deck receiving position and a closed, card dealing position extending across the top.

12. A card dealing case comprising a drawer-like housing having a horizontal base and an open top with a rim, a ramp surface formed by a forwardly inclined portion formed on the front wall of the housing at least adjacent the rim and a forwardly inclined rear wall upstanding from the base wall and confining a deck of cards stacked, face down, parallel to the base, with leading edges thereof adjacent the front wall surface;

a resiliently compressible member interposed between the deck and the base wall biassing the deck towards the rim so that the uppermost card is aligned with the ramp surface;

a sleeve-form cover receiving the housing and closing the top in a closed position and releasably engagable with the housing in the closed position, thereby retaining the deck therein;

whereby uppermost cards can be dealt horizontally by sliding them sequentially, one-by-one, leading edges first from the top of the pack up the ramp surface and out from the housing by downward and forward pressure of the dealer's hand.

13. A card dealing case according to claim 12 wherein the housing has a top wall extending horizontally across the top thereof to a location adjacent and spaced from the rim at the top of the front wall and rebated at a medial location so that the free edge thereof defines a narrow card exit aperture revealing therethrough only a leading strip portion of an uppermost card to be dealt without revealing identifying indicia on the card and defining a centrally located, enlarged aperture portion for receipt of a dealer's finger.

14. A card dealing case according to claim 13 in which the sleeve is blind ended and of parallelogram cross section perpendicular to an insertion axis, receiving the housing, end wall first and catch means are provided on the cover and housing, including one of indent and detent means manually overidable by insertion of a finger through a finger receiving access aperture provided in the blind end of the cover by which the housing can be pushed out of the sleeve.

15. A card dealing case according to claim 14 in which resiliently compressible member is solid foam.

16. A card dealing case according to claim 12 in which the top wall is constituted by a flap pivotally connected to one of the rear and side walls.

17. A card dealing case comprising a housing having a horizontal base and an open top with a rim, means defining a ramp surface extending from the housing interior to a front of the rim, and means locating a deck of cards stacked, face down, parallel to the base, therein with a leading edge of an uppermost card in alignment with the ramp surface;

cover means comprising a blind-ended sleeve receiving the housing in drawer fashion, rear first, to close the top, retaining the deck in the housing and catch means including one of indent and detent means provided on front edges of the rim and on the sleeve, respectively, engageable in a closed position and manually overridable by insertion of a finger through a finger receiving access aperture provided in the blind end of the cover by which the housing can be pushed out of the sleeve;

whereby uppermost cards can be dealt horizontally by sliding them sequentially, one-by-one, leading edges first from the top of the pack up the ramp surface and out from the housing by downward and forward pressure of the dealer's hand.

18. A card dealing case according to claim 17 in which complementary interengagable rib and groove means extend in an axial direction on the cover and housing, interengagable in a sliding fit to guide the housing into and out from the cover.

19. A card dealing case comprising a housing having a horizontal base and an open top with a rim, a forwardly inclined front wall defining a ramp surface which extends from the housing interior to the rim, and means locating a deck of cards stacked, face down, parallel to the base, therein with a leading edge of an uppermost card in alignment with the ramp surface;

cover means releasably engagable with the housing to close the top retaining the deck in the housing and comprising a flap extending across the top to a location adjacent and spaced from the rim at the top of the front wall and rebated at a medial location so that the free edge thereof defines with the rim a narrow card exit aperture revealing therethrough only a leading strip portion of an uppermost card to be dealt without revealing identifying indicia on the card and defining a centrally located, rearwardly extending enlarged aperture portion for receipt of a dealer's finger, whereby uppermost cards can be dealt horizontally by sliding them sequentially, one-by-one, leading edges first from the top of the pack up the ramp surface and out from the housing by downward and forward pressure of the dealer's hand.

20. A card dealing case according to claim 19 in which the cover is a sleeve-form construction and receives the housing in the closed position and is moveable to a partly open position in which the front of the housing protrudes from the cover exposing the card dealing and finger receiving aperture, engagement between the cover and the flap maintaining the flap in the card dealing position.

21. A card dealing case comprising a housing having a horizontal base and an open top with a rim, a ramp surface which extends from the housing interior to the rim, and means locating a deck of cards stacked, face down, parallel to the base, therein with a leading edge of an uppermost card in alignment with the ramp surface;

a cover member releasably engagable with the housing to close the top retaining the deck in the housing and comprising a wall portion extending across the top to a location adjacent and spaced from the rim and which is rebated at a medial location so that a leading edge thereof defines with the rim a narrow card exit aperture revealing therethrough only a leading strip portion of an uppermost card to be dealt without revealing identifying indicia on the card and defining a centrally located, rearwardly extending enlarged aperture portion for receipt of a dealer's finger, whereby uppermost cards can be dealt horizontally by sliding them sequentially, one-by-one, leading edges first from the top of the deck up the ramp surface and out from the housing through the card exit aperture by downward and forward pressure of the dealer's hand.

22. A card dealing case according to claim 21 in which the cover member comprises a housing receiving sleeve and the wall portion is formed by an upper wall of the sleeve.

* * * * *